US011168526B1

(12) United States Patent
Hughes

(10) Patent No.: US 11,168,526 B1
(45) Date of Patent: Nov. 9, 2021

(54) JET PUMP DRILLING ASSEMBLY

(71) Applicant: Hughes Tool Company LLC, Highlands Ranch, CO (US)

(72) Inventor: William James Hughes, Highlands Ranch, CO (US)

(73) Assignee: HUGHES TOOL COMPANY LLC, Highlands Ranch, CO (US)

( * ) Notice: Subject to any disclaimer, the term of this patent is extended or adjusted under 35 U.S.C. 154(b) by 0 days.

(21) Appl. No.: 17/240,946

(22) Filed: Apr. 26, 2021

Related U.S. Application Data

(60) Provisional application No. 63/017,850, filed on Apr. 30, 2020.

(51) Int. Cl.

| | |
|---|---|
| ***E21B 21/08*** | (2006.01) |
| ***E21B 21/12*** | (2006.01) |
| ***E21B 43/12*** | (2006.01) |
| ***E21B 7/04*** | (2006.01) |

(52) U.S. Cl.
CPC ..... *E21B 21/085* (2020.05); *E21B 7/04* (2013.01); *E21B 21/12* (2013.01); *E21B 43/124* (2013.01)

(58) Field of Classification Search
CPC ..... E21B 21/00; E21B 21/08; E21B 21/085; E21B 21/12; E21B 43/124; E21B 7/04; E21B 7/046
See application file for complete search history.

(56) References Cited

U.S. PATENT DOCUMENTS

| | | | | | |
|---|---|---|---|---|---|
| 2,029,457 | A * | 2/1936 | Beardmore | E21B 34/06 | 417/86 |
| 2,291,911 | A * | 8/1942 | William | E21B 43/124 | 417/172 |
| 2,594,405 | A * | 4/1952 | Deters | E21B 43/124 | 137/510 |
| 2,942,667 | A * | 6/1960 | Bridwell | E21B 21/00 | 277/333 |
| 2,946,565 | A | 7/1960 | Williams | | |
| 3,551,074 | A * | 12/1970 | Stout | E21B 43/124 | 417/172 |
| 3,958,651 | A * | 5/1976 | Young | E21B 10/18 | 175/340 |

(Continued)

FOREIGN PATENT DOCUMENTS

| | | | | |
|---|---|---|---|---|
| CA | 2315969 A1 * | 2/2002 | ..... | E21B 21/00 |
| GB | 2432380 A * | 5/2007 | ..... | E21B 21/085 |
| WO | WO-0214649 A1 * | 2/2002 | ..... | E21B 21/00 |

*Primary Examiner* — Jennifer H Gay
(74) *Attorney, Agent, or Firm* — Michael D. Reilly

(57) ABSTRACT

Disclosed herein are various embodiments of methods and systems for drilling a wellbore into an oil or gas production zone to prevent formation damage in the reservoir using underbalanced or near-balanced drilling techniques, wherein a jet pump drilling assembly is used to create a vacuum around the drill bit. The design of this jet pump drilling assembly prevents the flow of all drilling/power fluid from entering a drill bit Only fluids from the reservoir are allowed to enter the drill bit. The assembly includes a barrier to ensure that no drilling/power fluid discharged from the jet pump located above the drill bit can flow back around to the jet pump jet pump suction ports located in the drill bit thus preventing any drilling/power fluid from ever contacting the drill bit.

10 Claims, 5 Drawing Sheets

(56) References Cited

U.S. PATENT DOCUMENTS

| | | | | | |
|---|---|---|---|---|---|
| 4,390,061 | A * | 6/1983 | Short | E21B 41/02 | 166/372 |
| 4,605,069 | A * | 8/1986 | McClaflin | E21B 37/06 | 166/310 |
| 4,630,691 | A | 12/1986 | Hooper | | |
| 4,744,420 | A * | 5/1988 | Patterson | E21B 7/18 | 166/105 |
| 4,790,376 | A * | 12/1988 | Weeks | E21B 43/124 | 166/106 |
| 5,033,545 | A * | 7/1991 | Sudol | B08B 9/0433 | 166/312 |
| 5,355,967 | A | 10/1994 | Mueller et al. | | |
| 5,775,443 | A | 7/1998 | Lott | | |
| 6,877,571 | B2 * | 4/2005 | Hughes | E21B 43/124 | 175/57 |
| 9,376,874 | B2 * | 6/2016 | Reimers | E21B 21/12 | |
| 2007/0114063 | A1 * | 5/2007 | Wilfredo | E21B 21/08 | 175/57 |
| 2013/0206482 | A1 * | 8/2013 | Reimers | E21B 21/00 | 175/324 |
| 2014/0182849 | A1 * | 7/2014 | Kumbhar | E21B 43/114 | 166/255.1 |
| 2019/0178079 | A1 * | 6/2019 | Falk | E21B 47/10 | |

* cited by examiner

JET PUMP DRILLING ASSEMBLY

CROSS REFERENCE TO RELATED APPLICATIONS

This application claims the benefit of U.S. Provisional Patent Application No. 63/017,850, entitled "Jet Pump Drilling Assembly" to William James Hughes, filed on Apr. 30, 2020, which is hereby incorporated by reference in its entirety.

This application is related to U.S. Utility patent application Ser. No. 17/113,005 entitled "Annular Pressure Cap Drilling Method" to William James Hughes, filed on Dec. 5, 2020 which is hereby incorporated by reference in its entirety.

This application is related to PCT International Patent Application No. PCT/US2020/063522 entitled "Annular Pressure Cap Drilling Method" to William James Hughes, filed on Dec. 6, 2020 which is hereby incorporated by reference in its entirety.

FIELD

Various embodiments described herein relate to drilling oil and gas wells and the production of oil and gas, and devices, systems and methods associated therewith.

BACKGROUND

This patent application is one of a series of applications which relate to near balanced reservoir drilling, hereinafter referred to as "NBRD". The benefits of the inventions presented here are best understood when the reader is familiar with the history of drilling for oil and gas, and therefore an overview of that history is presented here.

The earliest oil wells were drilled using cable tool drilling, which is also known as ballistic well drilling. Cable rigs raise and drop a cable with a heavy carbide tipped drill bit which chisels through the rock, crushing the subsurface rock formation. The rate of drilling is slow.

Cable tool drilling uses a chisel styled drill bit suspended by a cable. It does not use a mud system, wherein drilling mud is circulated to remove the cuttings. The drill bit must be removed periodically from the borehole so that a bailer may be lowered to retrieve the drill cuttings. The bailer is a bucket-like tool with a trapdoor in the base. If the well is dry, water may be added to allow the cuttings to flow into the bailer. Removing and replacing the drill bit and cable slows down the rate of penetration even further. The advantage of not using a drilling mud system is that formation damage is minimal. Therefore cable tool drilling may be described as the first underbalanced drilling technique, where the pressure of the fluid in the wellbore is less than the pressure of the fluids in the formations being drilled.

By the early 1900s the quest for faster drilling and the need to drill to greater depths led to the development of rotary drilling with roller cone drill bits. Rotary drilling was used as long ago as 1845 with drag bits, but really became the preferred technique following the introduction of the steam-driven rig, and drilling mud instead of water, by Anthony Francis Lucas at Spindle top in 1901. Other inventions followed rapidly. See, for example, U.S. Patent 930,758 to H. R. Hughes, entitled "Drill", filed in 1908. Rotary drilling is still in use to the present day.

In rotary drilling, the drill bit is constantly rotating and in contact with the rock formation, which creates heat and thus wears out the drill bit. The drill bit must be lubricated to extend its useful life, and the lubricating fluid also serves to cool the bit, again extending its life. Drilling with just water proved ineffective, and therefore drilling muds of various compositions were developed. The drilling mud is pumped down the drill pipe, through the drill bit, and returns to the surface via the annulus between the drill pipe and the well bore. The drilling mud also removes the cuttings and brings them to the surface, where they are filtered out before the drilling mud is recirculated back into the well.

The weight of the drilling mud in the well exerts a pressure against the rock formation around the drill bit which often far exceeds the pressure of the fluids contained within the formation. This condition is referred to as "overbalanced". Drilling engineers rapidly adopted the overbalanced approach, because it prevented the blowouts caused by high pressure fluids in the formation, such as had happened at Spindletop. Heavier drilling muds were developed with the specific purpose of preventing any produced fluids entering the wellbore during drilling.

However, the result was extensive and largely irreversible damage to the rock formations as the high pressure drilling mud entered the pores of the rock and plugged them very effectively. Once drilling ceased and production began, the flow of the desired hydrocarbons was significantly reduced due to this formation damage. A further unintended negative consequence was that drillers often drilled through a previously unknown hydrocarbon bearing formation but failed to notice it. The drilling mud prevented any hydrocarbons entering the wellbore from this formation, and thus opportunities were missed.

For much of the 20th century, wells were drilled in formations which still produced even after the formation damage inflicted during drilling. The target formations were reservoirs where oil and gas had accumulated, and which had sufficient porosity, permeability and pressure to still produce. As these reserves were depleted, attention turned to the source rocks, which are mainly tight shales with lower porosity and permeability. While such formations may be capable of producing hydrocarbons, they cannot do so after the formation has been damaged by the high hydrostatic weight exerted by heavy drilling mud.

In the early 1990's, horizontal drilling had advanced to the point where it was now possible to drill one or more horizontal wellbores from a vertical well, into hydrocarbon bearing formations. A vertical well may intersect a producing formation and have a limited area of the well bore in the producing formation, perhaps tens of feet, or even hundreds, especially where the natural fracture system within the producing formation are tilted from vertical as in the Monterey formation of California. By drilling horizontally, or close to horizontally, and staying within the boundaries of the producing formation, drillers can increase the effective contact surface to thousands of feet and also intersect the natural fracture system.

In theory, the increased contact area should more than make up for the lower porosity and permeability in the shale formations. In practice, these formations are very susceptible to formation damage when drilled overbalanced. The industry therefore adopted hydraulic fracturing as a way to blast through the damaged zones and restore production. Hydraulic fracturing, known as "fracing" within the industry or "fracking" in the media, involves pumping fluids, usually water mixed with various chemicals and sand, into the wellbore under high pressures. Although intended to remedy the damage to the formation, fracking may have the opposite result because it by itself causes other types of formation damage from the injection of large amounts of water.

A further disadvantage of hydraulic fracturing is that many of the producing formations where it is employed are shales. Shales by volume contain a large percentage of clay fines which expand on contact with water. The expansion further reduces the porosity and permeability, blacking the path of the hydrocarbons from the formation into the wellbore.

In response to the problems described above, some companies adopted underbalanced drilling. In what may be termed "conventional" underbalanced drilling, the well is drilled using a modified drilling fluid with a lower density, thereby reducing the hydrostatic pressure exerted at the drill bit by the column of drilling fluid. When this hydrostatic pressure is lower than the pressure of the fluids in the formation, the operation is considered to be "underbalanced". Formation damage caused by plugging of the rock pores is avoided, and the porosity and permeability of the formation are not impacted.

In one approach, gas is injected into the drilling fluid to lower the effective weight while still lubricating and cooling the drill bit and removing cuttings. Nitrogen is often used for safety reasons. The present invention does not use gas injection to achieve underbalanced conditions. Instead, in part it relies on the use of a fluid with a lower density than conventional drilling mud. This avoids the additional costs and complexity of a gas injection system. A less dense fluid such as mineral oil will not necessarily by itself create the underbalanced condition. As described below, mineral oil when used in combination with the jet pump will create the underbalanced condition even in underpressured reservoirs.

Drilling underbalanced does not offer the protection from blowouts afforded by the heavy drilling mud of overbalanced drilling. Therefore additional precautions must be taken and additional equipment installed to handle any possible excess pressure situation. Because oil or gas is encouraged to flow from the formation into the wellbore, underbalanced drilling also requires planning and equipment to handle the produced hydrocarbons, and any produced water, during the drilling operation.

It is possible to drill a vertical well using the overbalanced approach, and then switch to underbalanced drilling to drill one or more lateral wells from the vertical well. This reduces the risk of blowouts while drilling the vertical well through formations where the fluid pressure may not be as well known as in the target reservoir formation. Any formation damage inflicted upon the reservoir in the vertical well is of no consequence because a horizontal wellbore will be used to produce the well. The vertical well may penetrate the productive formation and be sealed off. Then the vertical well will be re-entered to drill a horizontal wellbore using the underbalanced approach. The exit technique which mills through the casing is called "window milling".

While conventional underbalanced drilling may seem to be an effective technique, there are some drawbacks. Allowing fluids to flow too rapidly from the formation can lead to fines migration, wherein the pores become blocked by particles from within the formation. Shales with high clay content are especially susceptible to this problem. These problems can be addressed by Near Balanced Reservoir Drilling, where the pressure of the drilling fluid is maintained at a level which permits control of the production from the reservoir.

For a discussion of the issues relating to Near Balanced Reservoir Drilling, including operator safety and production while drilling, see U.S. Utility patent application Ser. No. 17/113,005 entitled "Annular Pressure Cap Drilling Method" to William James Hughes, filed on Dec. 5, 2020 which is hereby incorporated by reference in its entirety.

The objective of NBRD method is to minimize multiple formation damage mechanisms such as solids entrainment, fines migration, clay mineral swelling just to name a few. The primary benefit of this drilling process is to improve the recovery of oil and gas without stimulation. The intent of this technique is to use an energized fluid to lower bottomhole pressure while drilling to a point which is lower than the pressure within a formation being drilled, thus preventing the drilling fluid from entering the pores and fractures of the producing formation.

In order for this approach to be successful, the entire process must remain underbalanced from the time of the first contact with the producing formation through the production process. That includes any maintenance procedures, changing drill bits, and other procedures. The advantages of underbalanced drilling or NBRD are lost with even short period where the well is overbalanced. Maintaining the underbalanced condition 100% of the time must include being underbalanced both in front of and behind the drill bit. Conventional underbalanced drilling does not ensure that an underbalanced condition is maintained in front of the drill bit.

In current drilling methods, even those who claim to be underbalanced are not underbalanced ahead of the drill bit. Within the dynamic drilling environment around the drill bit, the fluids which exit from the bit are used to lubricate the drill bit plus remove the cuttings are under a higher pressure than the formation pressure of the rocks being drilled. This overbalanced condition in front of the bit causes damage to shale reservoirs in particular because the drilling fluids enter the naturally occurring microfractures and destroy the near wellbore permeability of the formation. Even though the overbalanced condition in front of the bit exists for a short period of time, it is sufficient to cause irreversible damage to the pores and microfractures around the drill bit location.

Some operators have developed techniques to reduce the pressure but not necessarily be underbalanced around the drill bit. Their objective has been to reduce chip hold down, not to address the problem of formation damage. In every case, these techniques create a localized lower pressure zone around the drill bit, but then revert to full overbalanced conditions above the drill bit. Formation damage is therefore still occurring during drilling operations.

The present invention addresses these concerns and offers several advantages over conventional underbalanced drilling. It does so by taking a very different approach to drilling, ensuring near balanced or underbalanced conditions during the entire time the lateral well is being drilled including in front of the bit.

One major difference between the present invention and conventional drilling, whether overbalanced or underbalanced, is that no drilling fluid exits out of the drill bit into the space between the drill bit and the formation being drilled. This would seem to defy the conventional thinking that fluid must be pumped through the drill bit for lubrication and cooling. However, it will be apparent to one of ordinary skill in the art after reading this specification that the lateral drilling is taking place in a formation which is a known producer of hydrocarbons. Water may also be produced. These fluids are sufficient to lubricate and cool the drill bit. This approach requires that the well be drilled underbalanced or slightly underbalanced above the drill bit and that a vacuum be created in front of the drill bit, so that the fluids can flow out of the formation into the wellbore. The direction of formation fluid flow is up through the drill bit, which is the direct opposite of conventional drilling. Previous jet pump assist technologies allow drilling fluids to flow down through and out of the drill bit, so the upward flow of only produced fluids through the drill bit distinguishes the present application from these earlier systems.

Another aspect of the present invention which distinguishes it from the prior art is that other jet pump assist technologies are not designed to be underbalanced behind the bit, they only reduce pressure in front of the bit but not enough to allow oil and gas to enter the wellbore as with underbalanced conditions. The other jet pump technologies must maintain full overbalanced conditions behind the bit and reduced overbalanced conditions in front of the bit for well control, so that the well does not produce hydrocarbons while drilling. In contrast, the present invention is designed to encourage hydrocarbons to enter the wellbore not only in front of the bit but also behind the bit while drilling. Production while drilling is therefore an expected result, not an anomaly, and the equipment and facilities to handle the production safely will be installed as part of the embodiments described herein.

In the embodiments described below, a jet pump stabilizer located just behind the bit is used to create a vacuum around the drill bit. Creating the vacuum requires a pressure barrier to seal the annulus between the wellbore and the body of the jet pump stabilizer, to separate the discharge side of the jet pump stabilizer from the suction side. Several embodiments of such a barrier are described below. The barrier performs two functions. It acts as a physical barrier to prevent drilling fluid flowing around the body of the jet pump stabilizer, and it separates the higher pressure on the discharge side of the jet pump stabilizer from the vacuum on the suction side of the jet pump stabilizer.

The fluid pumped down the drill pipe is now referred to as power fluid. Its purpose is to power the jet pump. As stated above, no fluid is pumped through the drill bit. Power and formation fluids are discharged into the return annulus above the jet pump which is located behind the drill bit. They are prevented from flowing back around the jet pump stabilizer to the drill bit because they are blocked by the barrier. Fluids from the pores and microfractures of the rock formation are encouraged to flow into the vacuum around the drill bit, then through the drill bit, then through the jet pump which is housed in a stabilizer, and up to the surface in the return annulus. Maintaining this vacuum ensures that the formation is not damaged by high pressure fluids. Since no formation damage is created, there is no need for stimulation such as hydraulic fracturing. The result is substantial costs and time savings over previous techniques.

Although the power fluid is pumped down the drill pipe under pressure, the pressure is reduced as it exits the jet pump stabilizer. Thus underbalanced conditions are achieved from the drill bit to the surface by adding energy to the return flow, essentially pumping the well for the duration of the drilling process. Maintaining underbalanced conditions enables continued production of hydrocarbons from the portion of the well behind the drill bit, in addition to the production from the zone immediately surrounding the drill bit.

The methods and systems described herein offer other benefits over conventional drilling. Previous techniques which attempted to create a lower pressure zone ahead of the drill bit were designed to address another consequence of hydraulic forces ahead of the drill bit, that is, chip hold-down. The cuttings are held in place against the rock face by the high pressures, rather than being removed from the zone between the drill bit and the rock face. The bit grinds the cuttings to smaller fragments, rather than cutting into the formation. This greatly reduces the rate at which the well is drilled and increases wear on the drill bit. The slower rate of penetration and the need to change out the drill bit both extend the time it takes to drill the well.

The improved techniques described below are primarily designed to ensure that the intrinsic rock formation characteristics are not damaged during the drilling process, while as an additional consequence, reducing chip hold down, increasing the rate of penetration and reducing wear on the drill bit.

A jet pump can also be used in the production of hydrocarbons in a completed well, where it provides an artificial lift mechanism, aka pumping, to enhance the flow of oil and gas from the formation into the wellbore. As described above, the presence of the barrier around the jet pump housing enables the creation of a low pressure or near vacuum in the lateral wellbore. In this situation a drill bit is not used. Instead a guide shoe is installed at the end of the jet pump housing. Guide shoes are industry standard fittings, available in a range of configurations, and serve to guide a string of tubing or casing as it is lowered into the well, especially around a curved wellbore, to the desired location for production.

Because the jet pump is not rotating when used in a production setting, there is no need for a stabilizer such as is used when drilling the well. The jet pump and guide shoe connection can therefore be contained within a simple jet pump housing.

Jet pumps provide several advantages over other types of pump in a lateral well. Rod driven pumps cannot operate in a lateral well. Electric pumps are typically too long to be lowered past the curve where the well transitions from vertical to horizontal. They must be positioned at the top of the curve. This leaves a column of fluid in the well below the pump, which exerts a hydrostatic pressure against the formation. This hydrostatic pressure against the formation inhibits production of oil and gas. By contrast, jet pumps are small, and can be positioned anywhere within the vertical or lateral well.

The rod driven and electrical pumps cannot handle solids, and quickly malfunction if the produced fluids contain significant amounts of solids. Jet pumps are much better suited at producing solids and formation fluids without damaging the pump.

It is possible to drill a lateral well using the embodiments described above, and then produce hydrocarbons through the drill bit using the jet pump because it already has the required barrier in place without the need to pull the drill string out of the well. The bottom hole assembly can be simply left in place, or pulled back closer to the vertical well. At some future time, when appropriate, the bottom hole assembly can be replaced with a jet pump housing and guide shoe.

SUMMARY

In one embodiment, there is provided a system for drilling an oil, gas, geothermal, or sequestration well or disposal reservoir comprising: a rotary drill bit; a jet pump stabilizer attached to the rotary drill bit; the jet pump stabilizer housing a jet pump, the jet pump having a suction side and a discharge side; and a pressure barrier surrounding the jet pump stabilizer between the suction side of the jet pump and the discharge side of the jet pump, and wherein no drilling fluid is allowed to flow into or out of the rotary drill bit.

In another embodiment, there is provided a system for drilling an oil or gas well wherein a vacuum is created in front of a rotary drill bit while maintaining underbalanced conditions in a return annulus from the rotary drill bit discharge ports back to the surface to allow the well to produce oil and gas while drilling, comprising: a rotary drill bit; a jet pump stabilizer attached to the rotary drill bit; the jet pump stabilizer housing a jet pump, the jet pump having a suction side and a discharge side and a pressure barrier surrounding the jet pump stabilizer between the suction side of the jet pump and the discharge side of the jet pump and wherein no drilling fluid is allowed to flow into or out of the rotary drill bit.

In another embodiment, there is provided a system for producing oil or gas from a well wherein a vacuum is created in a lateral wellbore comprising: a jet pump contained in a jet pump housing situated in the lateral wellbore; a jet pump contained within the jet pump housing, the jet pump having a suction side and a discharge side; a pressure barrier surrounding the jet pump housing between the suction side of the jet pump and the discharge side of the jet pump; a power fluid to operate the jet pump, and a suction port further comprising a guide shoe attached to the suction side of the jet pump.

Further embodiments are disclosed herein or will become apparent to those skilled in the art after having read and understood the specification and drawings hereof.

BRIEF DESCRIPTION OF THE DRAWINGS

Different aspects of the various embodiments of the invention will become apparent from the following specification, drawings and claims in which:

The drawings are not necessarily to scale. Like numbers refer to like parts or steps throughout the drawings.

DETAILED DESCRIPTION OF SOME EMBODIMENTS

Figure 1:
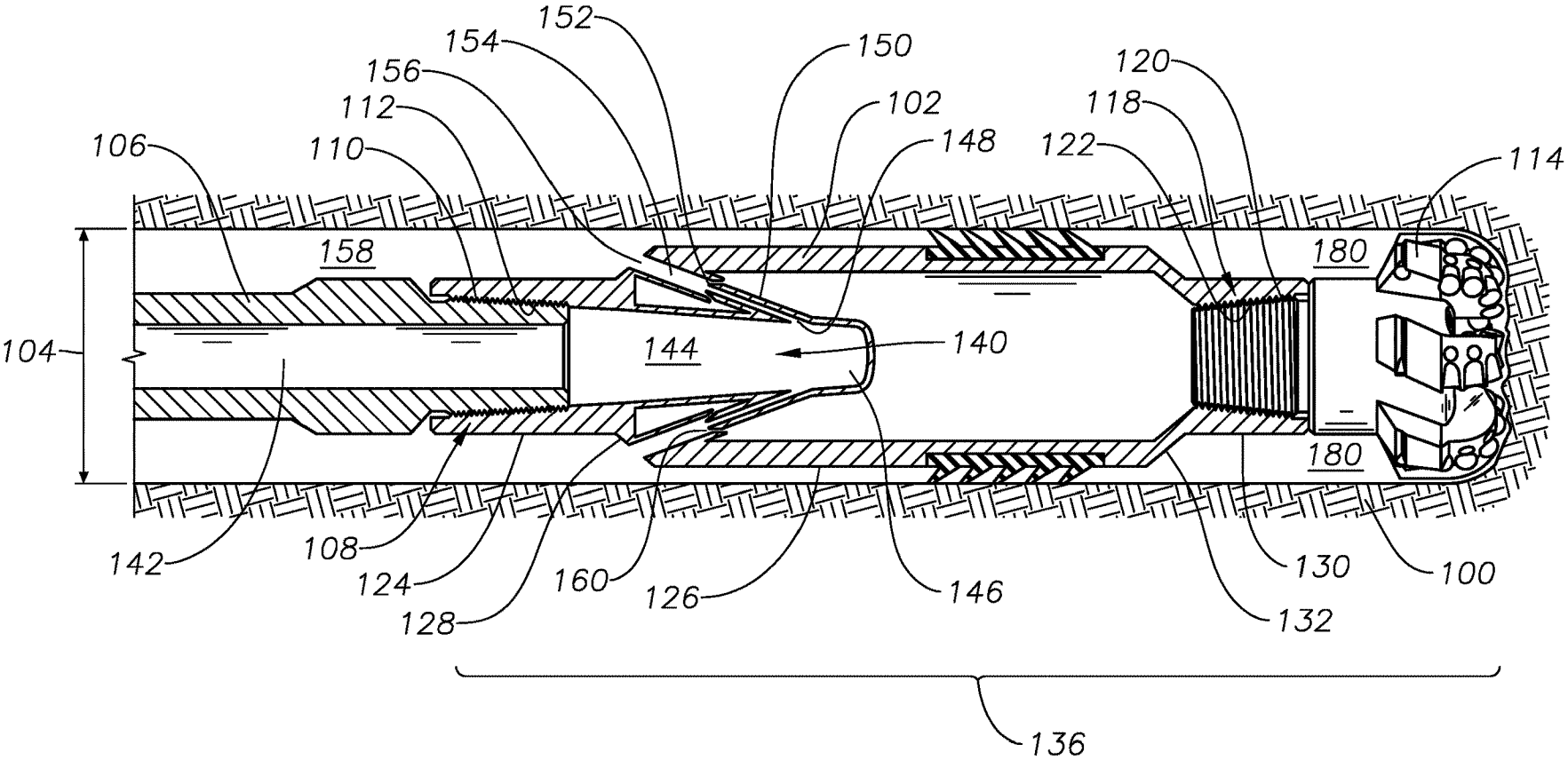
FIG. 1 shows a cross section of a jet pump stabilizer using swab cups as a barrier.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Some embodiments in the present application refer to "jet pump drilling". That is, a modified hydraulic jet pump is used during the drilling process to create pressure differentials for various purposes. This should not be confused with "water jet drilling", in which a high pressure jet of water or other fluid is used to cut through the rock or with "jet assist drilling" where drilling fluid exits the drill string above the drill bit in order to provide additional hydraulic power to the return annulus while drilling.

As used herein, the term "jet pump" means an apparatus having a nozzle, a throat, and a diffuser which transfers energy from a power fluid to a drilling and/or production fluid to artificially lift and remove drilling fluids and produced fluids from a well thereby decreasing the hydrostatic weight of the combined fluid column. In addition for a hydraulic jet pump to properly function it must have a barrier located between the suction side and discharge side of the pump.

As used herein, the term "jet pump stabilizer" means a jet pump contained within a body or housing having an external diameter close to, but slightly less than, the diameter of the drill bit, and hence the diameter of the wellbore made by the drill bit. One purpose of the jet pump stabilizer, as the name implies, is to keep the downhole assembly—the drill bit and stabilizer—centered in the well bore.

As used herein, the term "bladder" means a device which provides a barrier by inflating or expanding from a first position into a second position to make contact with a open hole wellbore or casing to force produced fluids into through a drill bit and then into the jet pump.

Unlike conventional underbalanced drilling the NBRD technique addresses the issue of multiple potential formation damage mechanisms. It starts with replacing heavy drilling mud as the primary means of controlling pressure in the well with other surface BOP equipment that are placed below the traditional BOP stack. Such equipment allows the safe use of a light drilling fluid, such that the weight of the column of drilling fluid exerts less pressure against the hydrocarbon bearing formation. However, the one place in which the formation pressure is usually exceeded is the small area of the well bore ahead of and surrounding the drill bit. The drilling fluid can enter the side walls of the well bore under pressure, and cause enough formation damage to the pores and microfractures within the formation to adversely impact permeability, and hence the production of hydrocarbons during and after drilling.

In order to achieve true slightly underbalanced, that is, near balanced conditions, the present invention provides a jet pump to create the low pressure zone both above and below the drill bit using a barrier around the jet pump separating the suction side from the discharge side to prevent discharged fluid from circulating around the jet pump and back into the suction side of the jet pump, and to ensure that all fluids produced in front of the bit flow up through the drill bit and into the pump and not around the pump. Various embodiments of this barrier are described below.

Another issue facing the driller which is addressed by the present invention is the "chip hold-down effect", which happens when the chips of rock loosened by the drill bit are held in place by the pressure of the drilling fluid and are not immediately moved uphole. The rotating drill bit is then just re-drilling the chips to a finer and finer powder. This slows down the drilling rate of penetration (ROP) and increases wear on the bit. Increased wear may mean that the drill bit has to be changed, possibly several times. This increases costs, not only for replacing the drill bits, but also for the time taken to extract the bit, change it, and reposition it in place to resume drilling.

The key to increasing ROP and reducing drill bit wear is to move the rock chips away from the bit as quickly as possible and let the drill bit grind on the formation. Some techniques to do this use a modified jet pump which has no barrier to separate the suction side from the discharge side of the jet pump to decrease the bottomhole pressure, with the intent to remove cuttings more effectively.

Many of these techniques add a complication by trying to create a lower pressure at the drill bit while maintaining the required overbalanced condition, that is, higher pressures, for the column of drilling fluid from the drill bit back to the surface. By contrast, the present invention aims to keep a negative or low underbalanced condition all the way to the surface, by providing added energy to the returning power and formation fluids thus assisting in removing the rock chips.

Prior drilling techniques pump fluid through the drill bit which still exerts pressure on the rock face as it is being drilled. Conventional thinking is that fluid must be pumped through the drill bit to lubricate the drill bit and reduce wear on the cutting faces. The jet pump drilling method described herein uses only the reservoir fluids to lubricate the drill bit. Therefore this jet pump drilling method is a radical departure from conventional drilling because the present invention does not allow drilling fluid to be pumped through nozzles or ports and out the drill bit. Because the wellbore ahead of the bit is under a vacuum, hydrocarbons will be flowing out of the formation and this flow is what lubricates the drill bit. The drill bit is configured with ports originally designed to accept nozzles which now become suction ports to allow produced fluids to flow up through the drill bit. In some embodiments, these suction ports may be specifically engineered to promote the reverse flow up through the drill bit. In other embodiments, the suction ports may be the conventional drilling ports, or even holes in the drill bit intended for the insertion of nozzles, but now serving to permit the internal upward flow through the bit. It must be kept in mind that the techniques described in this application are used only when drilling a lateral well in a producing formation. Conventional methods are employed when drilling the vertical section of the well, including overbalanced drilling and lubrication and cooling of the drill bit by drilling fluid.

Creating a vacuum around the drill bit has the additional benefit of cleaning up the near wellbore region of the rock formation by extracting formation fines out of the formation, thereby increasing the effective permeability and enhancing the flow of hydrocarbons into the wellbore.

In many jet pump applications, cavitation is regarded as a problem because of increased wear. The equipment is designed or chosen to reduce the possibility or the intensity of cavitation. Cavitation can damage parts, and result is a serious loss of efficiency in some cases. The high fluid flow speeds and significant pressure differential in the present application for drilling tends to induce a moderate amount of cavitation.

However, in the present application, cavitation is considered to be a positive feature. It assists with moving cuttings through the drill bit, thus keeping the drill bit free from debris. Because the present application does not pump drilling fluid through the drill bit, which is the traditional way of removing cuttings, the turbulence caused by the cavitation and jet pump suction along with formation fluids being produced while drilling enhances the removal of cuttings as produced fluids flow from the reservoir into the wellbore and then to the surface. Therefore some embodiments of the present invention may modify the design of the drill bit and the jet pump itself to encourage a degree of cavitation.

Referring now to the drawings, several possible embodiments of the present invention will be described. The invention can be implemented in numerous ways. The appended drawings illustrate only typical embodiments of the present invention and therefore are not to be considered limiting of its scope and breadth. In the drawings, some, but not all, possible embodiments are illustrated, and further may not be shown to scale.

In a conventional drilling operation, drill pipe extending from the surface well location to a rotary drill bit is rotated to drill the wellbore. In the present invention, a jet pump is placed between the downhole end of the drill pipe and the drill bit.

FIG. 1 illustrates one possible embodiment wherein a jet pump is used to enhance drilling operations. FIG. 1 shows the subsurface 100 of the earth within which a jet pump stabilizer 102 is being employed to aid in drilling a wellbore 104. As depicted in FIG. 1, the wellbore 104 is horizontal, but there would be no changes to the drawing or the description if the wellbore 104 were vertical or angled. The jet pump stabilizer 102 is attached to a drill pipe 106 by a screw thread coupling 108. Screw thread coupling 108 comprises a male thread 110 on the end of drill pipe 106 and a female thread 112 on the end of the jet pump stabilizer 102. A drill bit 114 is attached to the jet pump stabilizer 102 by a screw thread coupling 118. Screw thread coupling 118 comprises a male thread 120 on the drill bit 114 and a female thread 122 on the end of the jet pump stabilizer 102.

As will be apparent from FIG. 1, the diameter of the wellbore 104 is determined by the diameter of the drill bit 114. It will be understood by one of ordinary skill in the art that the dimensions may vary, but industry standards suggest that the drill pipe 106 is usually 2⅞" outside diameter, and the drill bit is usually 4¾" in diameter.

In the embodiment shown in FIG. 1, the section 124 of the jet pump stabilizer 102 which surrounds the screw thread coupling 108 has an outside diameter similar to the outside diameter of the drill pipe 106. The body 126 of the jet pump stabilizer 102 has an outside diameter slightly smaller than the diameter of the wellbore 104. A first sloping surface 128 connects these two sections of the jet pump stabilizer 102.

Similarly, the section 130 of the jet pump stabilizer 102 which surrounds the screw thread coupling 118 has an outside diameter similar to the outside diameter of the male thread 120 of the drill bit 114. A second sloping surface 132 connects section 130 to the body 126 of the jet pump stabilizer 102.

The combination of the jet pump stabilizer 102 and the drill bit 114 is sometimes referred to as a bottom hole assembly 136.

Figure 2:
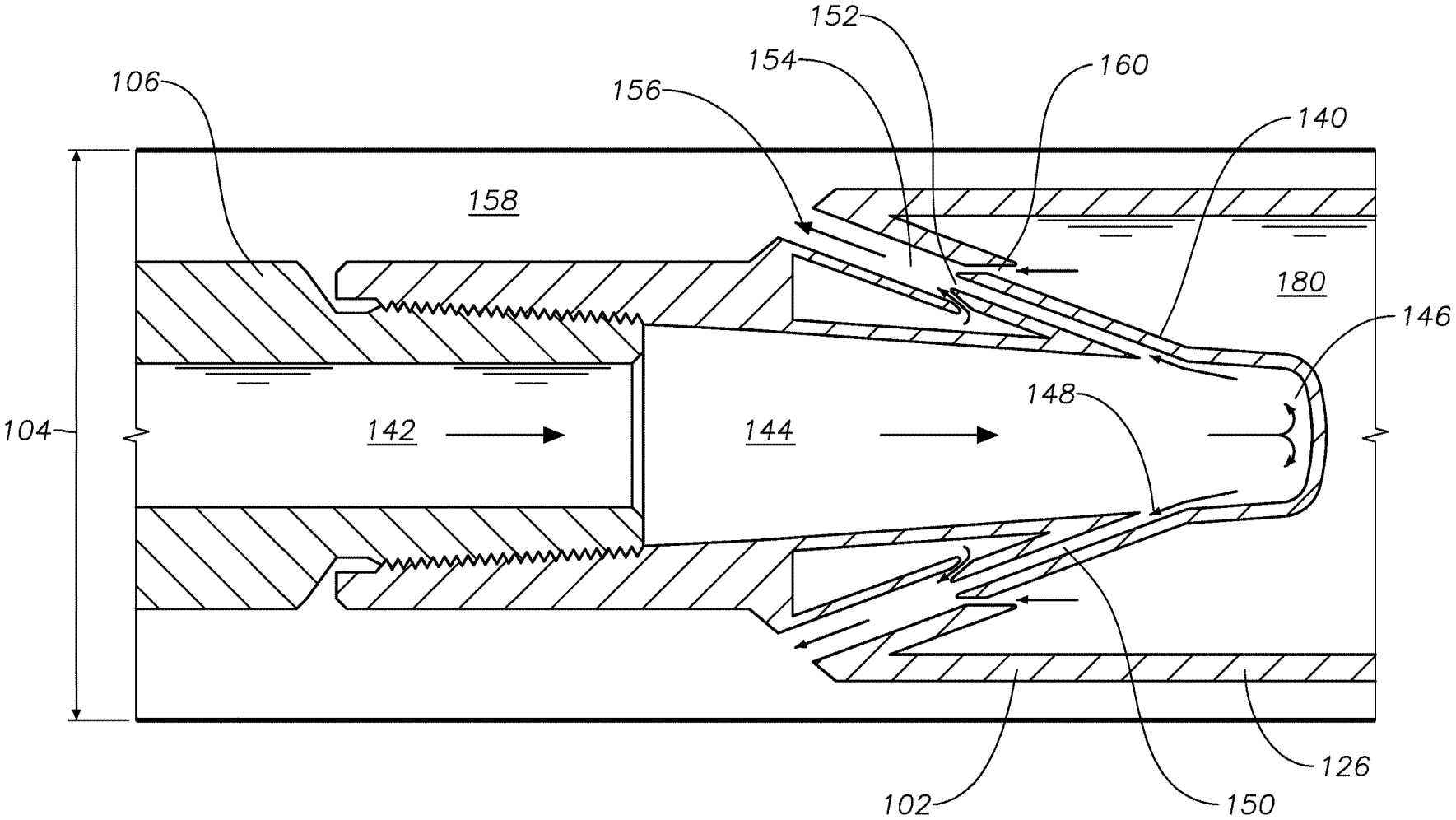
FIG. 2 shows an enlarged cross section of a jet pump stabilizer to show the jet pump.

As shown in FIG. 2, within the portion of the jet pump stabilizer 102 proximate the drill pipe 106 there is installed a venturi assembly 140. Power fluid 142 is pumped down the drill pipe 106 into the jet pump stabilizer 102, where it enters the cavity 144 of the venturi assembly 140. The closed end of the venturi assembly 140 acts as a U-tube 146 and reverses the direction of the flow of the power fluid 142. The power fluid 142 exits the cavity 144 through a plurality of discharge ports 148 and along a plurality of discharge tubes 150. Discharge tubes 150 are equipped with venturi nozzles 152, which open into expansion chambers 154. The power fluid 142 exits from the expansion chambers 154 through the exit ports 156 located on the first sloping surface 128, and is then returned to the surface up the annulus 158 between the wellbore 104 and the drill pipe 106.

In accordance with Bernoulli's theorem, as the power fluid 142 passes through the venturi nozzles 152 and into the expansion chambers 154, the fluid pressure drops. The expansion chambers 154 are connected to the body of the jet pump by suction ports 160. The low pressure in the expansion chambers 154 causes produced hydrocarbons and formation water to be sucked from within the body 126 of the jet pump stabilizer 102. This causes fluids to flow through the drill bit 114 from the rock interface into the jet pump stabilizer 102. Thus a low pressure zone 180 is created within the jet pump stabilizer and also around the drill bit 114. These fluids continue through the discharge ports 148 and along discharge tubes 150 to exit ports 156, and flow to the surface up the annulus 158 between the wellbore 104 and the drill pipe 106.

It will be understood by one of skill in the art that the dimensions of these various components may be varied to tune the performance of the jet pump and optimize the pressure differential and the fluid flow. For example, the venturi assembly 140 may extend further into the body 126 of the jet pump stabilizer 102 than shown. The body 126 of the jet pump stabilizer 102 may be longer than shown if a larger cavity is desired. The length will ultimately be limited by the need to place the entire bottom hole assembly 136 in the lateral well, which means it has to be short enough to pass through the curve where the well transitions from vertical to horizontal. The length, diameter, position and number of the discharge tubes 150 may vary, as may the distance of the discharge ports 148 from the end of the u-tube 144. The dimensions will be determined by a combination of factors, including the type, density and viscosity of the drilling fluid, the pressures of the drilling fluid and formation fluids, the flow rates of the fluids, and the expected size and quantity of cuttings to be removed.

The low pressure zone 180 which exists in the interface between the rock formation and the drill bit 114, is actually a partial vacuum, and thus creates underbalanced conditions ahead of the drill bit 114. One benefit of this low pressure zone is the reduction or elimination of chip hold down.

In order to maintain the low pressure zone 180 around the drill bit 114, ensure that the fluid flow is through the drill bit 114 and the jet pump stabilizer 102, and avoid power fluid flowing around the jet pump stabilizer 102 and reaching the drill bit 114, it is necessary to block the annulus between the jet pump stabilizer 102 and the well bore 104. This is done using a barrier, which is installed around the jet pump stabilizer 102. Some embodiments of this barrier are described below, but it will be apparent to one of ordinary skill in the art after reading this specification and viewing the drawings that other methods of blocking the annulus are possible.

Figure 3:
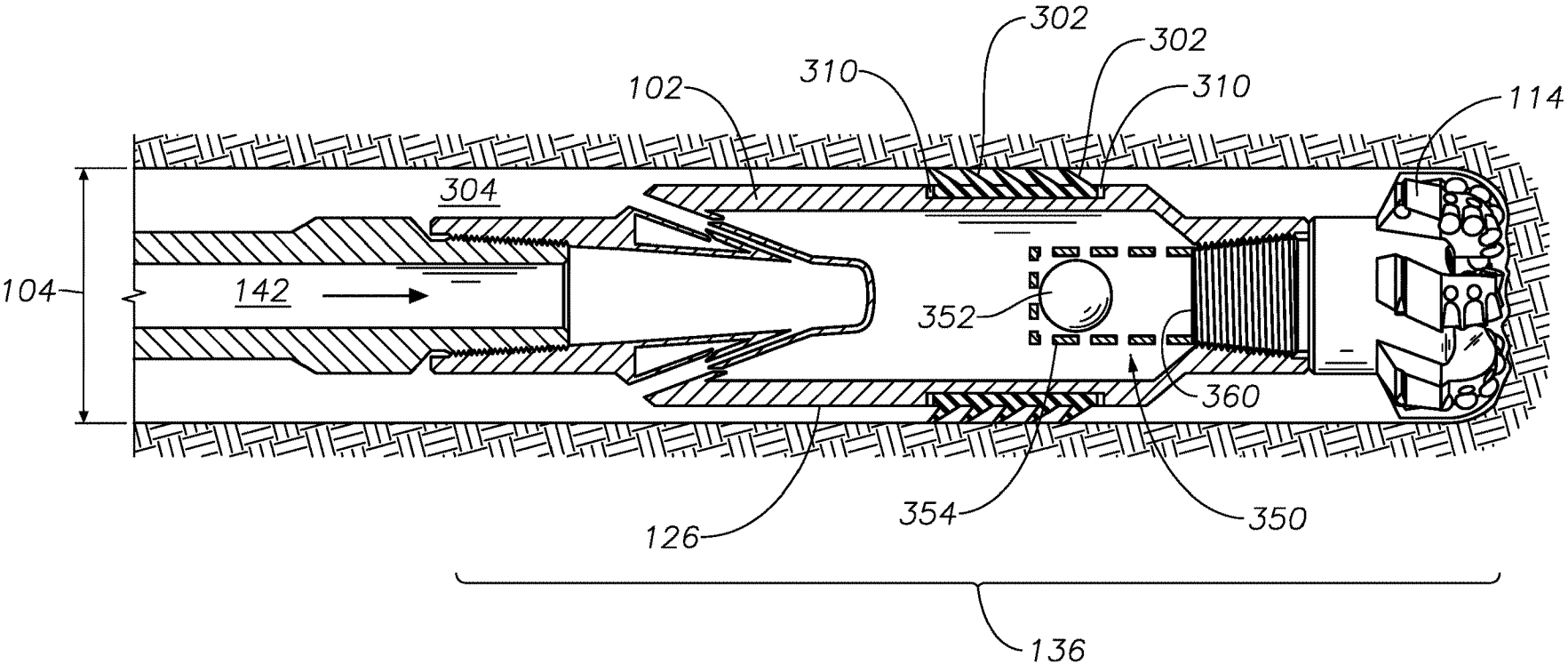
FIG. 3 shows an enlarged cross section of a jet pump stabilizer using swab cups as a barrier.

In one embodiment, as shown in FIG. 3, the barrier comprises a plurality of swab cups 302 installed around the jet pump stabilizer 102. Swab cups have been used in the production phase of the oil and gas business for many years, but their use while drilling is novel. The key feature of a swab cup is its shape, in that the weight or pressure of the power fluid 142 in the wellbore 104 forces the swab cup to expand in diameter, thus effectively blocking the annulus 304 between the jet pump stabilizer 102 and the well bore 104. As there is a vacuum created around the drill bit 114, the pressure differential is enhanced, and the swab cups 302 will grip even more tightly. The swab cups 302 possess sufficient elasticity to allow the drill bit 114 and jet pump stabilizer 102 to be advanced along the wellbore 104 as drilling progresses. Once drilling stops and the power fluid 142 is no longer being pumped downhole, the swab cups 302 will revert to their former shape, allowing the bottom hole assembly 136 to be withdrawn from the wellbore 104.

Swab cups are readily available wherever there is oil or gas production and are manufactured with a range of inside and outside diameters. The repurposing of the swab cups for use in drilling helps to reduce the cost of the drilling and production techniques described in this application.

In some embodiments, the swab cups 302 will be equipped with bushings 310 to allow rotation of the jet pump stabilizer 102 while the swab cups 302 remain stationary in contact with the wellbore 104. A non-rotating barrier can be used in a newly drilled, uncased wellbore, where friction against the rock formation would impede the movement of a rotating barrier. In other embodiments, the swab cups 302 will be affixed around the body 126 of the jet pump stabilizer 102 and will rotate with the jet pump stabilizer 102. This will result in wear on the swab cups 302, which were not originally designed to be used in a drilling operation, but they as they will only be subject to wear for a few days, this is not expected to be an issue. Because the swab cups 302 are flexible, any wear is compensated for by the swab cups 302 expanding further due to the weight of the power fluid 142.

In the production application, as the jet pump stabilizer 102 does not rotate, there is no need for bushings within the swab cups 302, nor is there an issue of wear on the swab cups 302.

The plurality of swab cups 302 may be positioned in contact with each other, or spaced at intervals along the body 126 of the jet pump stabilizer 102 to provide additional stabilization and assist with centering the jet pump stabilizer 102 within the wellbore 104.

Figure 4:
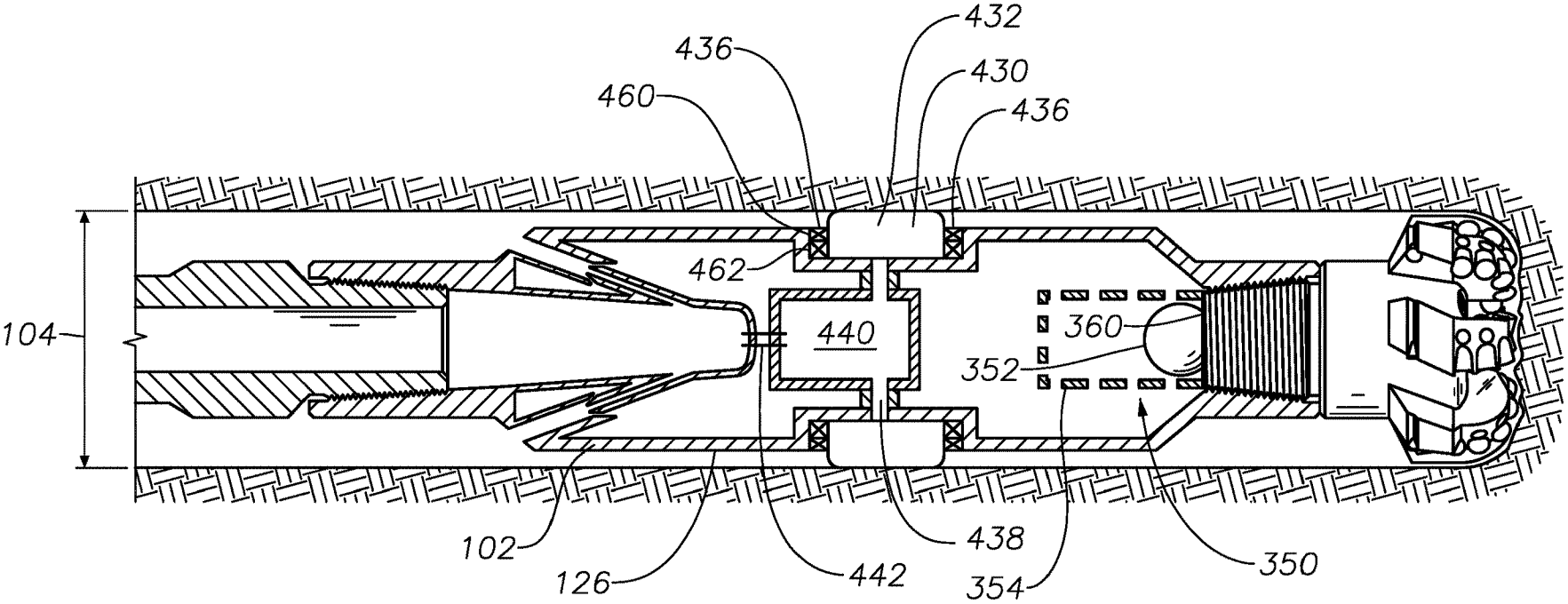
FIG. 4 shows an enlarged cross section of a jet pump stabilizer using an expandable bladder as a barrier.

As illustrated in FIG. 4, in other embodiments, the body 126 of the jet pump stabilizer 102 is encircled by a barrier 430, which comprises an expandable bladder 432, and bearings 436 at each end of the expandable bladder 432, the bearings 436 having an outer bearing part 460 attached to the body of the jet pump stabilizer 102 and an inner bearing part 462 attached to expandable bladder 432. Again, this embodiment uses a non-rotating barrier. In some embodiments, conduits 438 are positioned at intervals around the body of the jet pump stabilizer 102 to connect the space between the expandable bladder 432 through the walls of the jet pump stabilizer 102 to a pressure reduction chamber 440 inside the jet pump stabilizer 102. Pressure applied to the expandable bladder 432 from the pressure reduction chamber 440 through the conduits 438 expands the expandable bladder 432 against the surface of the wellbore 104, thereby forming a barrier against the flow of fluids past the jet pump stabilizer, and a pressure seal between the suction and discharge sides of the jet pump stabilizer.

The pressure reduction chamber 440 is employed because sufficient pressure is needed to form a tight seal against the surface of the wellbore 104, but the expandable bladder 432 is not designed to grip so tightly as to impede the movement of the jet pump stabilizer 102 along the wellbore 104 as drilling progresses. The power fluid 142 will be at a pressure measured in thousands of psi, whereas the expandable bladder 432 requires only a few hundred psi to inflate it against the wellbore 104. A valve 442 installed between the U-tube 146 and the pressure reduction chamber 440 lowers the pressure exerted on the expandable bladder 432. The optimal value of this pressure depends on several factors such as the coefficient of friction of the formation, and the area of the expandable bladder 432 in contact with the wellbore 104. Adjustments to valve 442 may be made in the field to suit the expected conditions.

In some embodiments, bearings 436 are tack welded to the body of jet pump stabilizer 102 such that the inner surface of the bearings 460 and the expandable bladder 432 remain stationary, held in place by the expandable bladder 432 pressing against the well bore 104, while the outer bearing surface of the bearings 462 and the body of the jet pump stabilizer 102 rotate.

As previously stated, the vacuum around the drill bit 114 should be maintained throughout the drilling process. However, the drilling process is not continuous. With every thirty feet drilled, drilling stops, and another length of drill pipe is attached to the drill string. As drilling resumes, the jet pump is activated and the pressure lowered again. In certain embodiments of the present invention, this temporary increase in pressure is prevented from reaching the drill bit 114 in two ways. First, the swab cups 302 or the barrier 430 prevent fluid flow around the jet pump stabilizer 102. Second, fluid is prevented from flowing back through the exit ports 156, down the discharge tubes 150, and into the body 126 of the jet pump stabilizer 102 through the suction ports 160. Referring back to FIG. 3, this is achieved by installing a ball check valve 350 within the body 126 of the jet pump stabilizer 102. The ball check valve 350 comprises a ball 352 contained in a cage or housing 354. Any increase in pressure within the body 126 of the jet pump stabilizer 102 will push the ball 352 into a machined seat 360 on the top of the drill bit 114. The low pressure zone 180 around the drill bit 114 is thus protected from the increase in pressure and the partial vacuum is maintained throughout the drilling process. FIG. 3 shows the ball check valve 350 in the open position, as it would be when the jet pump 102 is operational. FIG. 4 shows the ball check valve 350 in the closed position, as it would be when the jet pump 102 is not running. In some embodiments, a weak spring is used to assist the seating of the ball 352 into the machined seat 360.

It should be noted that prior art which claims to create low pressure at the drill bit is not concerned with maintaining this low pressure while adding drill pipe. The focus of the prior art is to reduce problems associated with chip hold down. When drilling stops, chips are not being created, nor reducing the rate of penetration, so maintaining the low pressure was not seen as a requirement.

Figure 5:
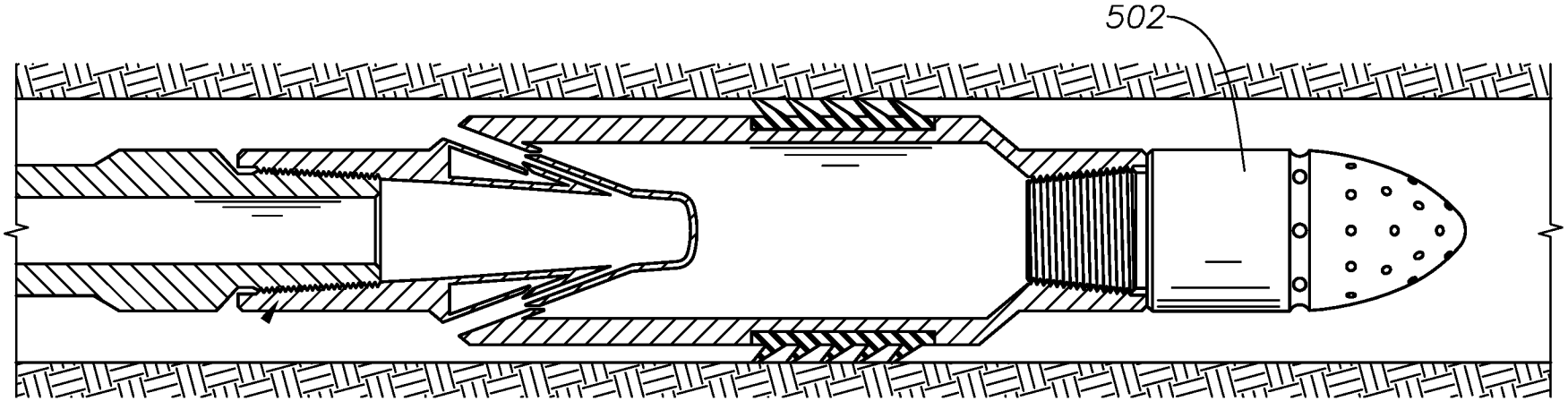
FIG. 5 shows a jet pump housing fitted with a guide shoe for use in a production environment.

When the jet pump is used to create artificial lift in a production setting, and when it is installed in an existing well, there is obviously no need for a drill bit. As shown in FIG. 5, a guide shoe 502 is installed to protect the pipe as it is lowered down the well. Other than that modification, the configuration is as described above. As previously discussed, the present invention affords substantial benefits when used to create a low pressure or partial vacuum in the wellbore. As in the drilling application, power fluid is pumped downhole to power the jet pump, but no power fluid enters the area ahead of the guide shoe 502. Produced fluids enter the wellbore 104 ahead of the guide shoe 502 and are passed through the guide shoe 502 and into the jet pump and discharged upwardly into the annulus of the well to the surface.

In order to appreciate the advantages of the present invention, it is helpful to see how it differs from prior art which references jet pumps.

Consider first U.S. Pat. No. 2,946,565 to Williams entitled "Combination Drilling and Testing Process", hereinafter "the Williams patent"; this patent clearly allows drilling mud to be pumped down through, and out of, the drill bit. In the present application, no drilling fluids are allowed through the drill bit. This patent hopes to achieve underbalanced conditions with a jet pump above the drill bit to encourage oil and gas to flow into the wellbore so mud logging testing equipment at the surface can better detect hydrocarbons. It makes clear that above the jet pump the annulus is overbalanced above the jet pump for well control whereas the present invention maintains underbalanced or near balanced conditions throughout the well. This patent does not mention the importance of preventing formation damage, and it essentially acknowledges that testing for hydrocarbons is better done before irreversible formation damage is caused by the overbalanced conditions above the jet pump. It is therefore a testing method, and not a production technique, and is not applicable when drilling a lateral where the objective is to produce from the entire length of the lateral wellbore as in the present application. The present invention is designed for production use, and is intended to drill the entire lateral section of the wellbore.

Consider also U.S. Pat. No. 5,355,967 to Mueller et al, entitled "Underbalance jet pump drilling method", hereinafter "the Mueller patent". In the Mueller patent, the flow of the drilling fluid through the jet pump is directed down and into the drill bit. In the present invention, the flow through the jet pump is upwards, and no drilling fluid flows through the drill bit. In this patent, there is no barrier separating the suction side and the discharge side of the jet pump, suggesting that this approach is really a jetting technique rather than a pumping technique. Without a physical barrier, it is difficult to see how the approach described in this patent maintains high pressure above the drill bit and low pressure below the drill bit.

The Mueller patent diverts drilling fluid through the drill bit to lubricate and cool the bit, functions which in the present application are performed by the produced fluids. The Mueller patent refers to using the drilling fluid to entrain the cuttings and remove them. The present invention uses a vacuum and the flow of produced fluids to remove the cuttings up through the drill bit. The Mueller patent requires a total redesign of the drill bit, foregoing the benefits of many years of development of the roller cone drill bit and greatly increasing costs. The present invention uses conventional off-the-shelf drill bits. For these multiple reasons, the present invention is more practical and cost-effective than the invention described in the Mueller patent.

Consider also U.S. Pat. No. 5,775,443 to Lott entitled "Jet pump drilling apparatus and method", hereinafter "the Lott patent". Once again, this patent is distinguished from the present application because it divides the drilling fluid into two streams and pumps drilling fluid down through the drill bit. The main goal of the Lott patent is to remove cuttings by creating a low pressure area at the bottom of the wellbore. The Lott patent requires a total redesign of the drill bit, foregoing the benefits of many years of development of the roller cone drill bit and greatly increasing costs. The present invention uses conventional off-the-shelf drill bits.

Consider also U.S. Pat. No. 4,630,691 to Hooper entitled "Annulus bypass peripheral nozzle jet pump pressure differential drilling tool and method for well drilling", hereinafter "the Hooper patent". Although this patent does show fluid flowing up through the drill bit, it must be noted that this is drilling fluid which is pumped down the annulus and flows back up through the drill string in a technique known as reverse circulation. This technique is used in specific situations and would not be used in most drilling projects. The present application does not use reverse circulation. In the Hooper patent, the modulating plug is not intended to provide a complete seal, rather, it is described as a controlled annulus by-pass. Fluid is allowed to flow around the plug, as shown in FIGS. 2-6, in contrast to the present application where no fluid is allowed to flow downward past the barrier and around the jet pump stabilizer and into the face of the drill bit. A further distinguishing feature is that in the Hooper patent, the design intends that the wellbore above the drill bit be overbalanced, which permits formation damage to occur behind the drill bit.

In summary, the common objective for all the prior art is to be underbalanced or at least create a lower pressure around the bit to increase penetration, to reduce lost circulation and in at least one case, to improve hydrocarbon detection, but then be overbalanced above the jet pump for well control. No prior art describes creating a vacuum around the drill bit and then remaining underbalanced all the way back to the surface. No prior art describes preventing drilling fluid from flowing in or out of a drill bit. No prior art speaks of using reservoir fluids to lubricate the drill bit.

It should be noted that many of the structures, materials, and acts recited herein can be recited as means for performing a function or step for performing a function. Therefore, it should be understood that such language is entitled to cover all such structures, materials, or acts disclosed within this specification and their equivalents, including any matter incorporated by reference.

It is thought that the apparatuses and methods of embodiments described herein will be understood from this specification. While the above description is a complete description of specific embodiments, the above description should not be taken as limiting the scope of the patent as defined by the claims.

Other aspects, advantages, and modifications will be apparent to those of ordinary skill in the art to which the claims pertain. The elements and use of the above-described embodiments can be rearranged and combined in manners other than specifically described above, with any and all permutations within the scope of the disclosure.

Although the above description includes many specific examples, they should not be construed as limiting the scope of the invention, but rather as merely providing illustrations of some of the many possible embodiments of this invention. The scope of the invention should be determined by the appended claims and their legal equivalents, and not by the examples given.

What is claimed is:

1. A system for drilling an oil, gas, geothermal, or sequestration well or disposal reservoir comprising;

a rotary drill bit;

a jet pump stabilizer attached to the rotary drill bit:

the jet pump stabilizer housing a jet pump, the jet pump having a suction side and a discharge side and a pressure barrier surrounding the jet pump stabilizer between the suction side of the jet pump and the discharge side of the jet pump, and wherein no drilling fluid is allowed to flow into or out of the rotary drill bit.

2. The system of claim 1, further comprising a ball and seat check valve connected to the rotary drill bit to prevent back flow through the rotary drill bit when fluid circulation is stopped.

3. The system of claim 1, wherein the only fluid allowed to flow through the rotary drill bit is fluid produced from the formation being drilled.

4. The system of claim 1, wherein the rotary drill bit is lubricated and cooled only by the fluids produced from the formation being drilled.

5. The system of claim 1, wherein the jet pump and the rotary drill bit are designed such that the suction from the jet pump creates cavitation within the drill bit which cleans debris from the drill bit.

6. A system for drilling an oil or gas well wherein a vacuum is created in front of a rotary drill bit while maintaining underbalanced conditions in a return annulus from the rotary drill bit discharge ports back to the surface to allow the well to produce oil and gas while drilling, comprising;

a rotary drill bit;

a jet pump stabilizer attached to the rotary drill bit;

the jet pump stabilizer housing a jet pump, the jet pump having a suction side and a discharge side and a pressure barrier surrounding the jet pump stabilizer between the suction side of the jet pump and the discharge side of the jet pump and wherein no drilling fluid is allowed to flow into or out of the rotary drill bit.

7. The system of claim 6, wherein the only fluid allowed to flow through the rotary drill bit is from a hydrocarbon bearing formation.

8. The system of claim 6, wherein the rotary drill bit is lubricated and cooled only by the fluids from the formation being drilled.

9. The system of claim 6, wherein the jet pump and the rotary drill bit are designed such that the suction from the jet pump creates cavitation within the drill bit which cleans debris from the drill bit.

10. The system of claim 6, further comprising a ball and seat check valve connected to the rotary drill bit to prevent back flow through the rotary drill bit when fluid circulation is stopped.

* * * * *